US006488294B2

(12) United States Patent
Lumb

(10) Patent No.: US 6,488,294 B2
(45) Date of Patent: Dec. 3, 2002

(54) SKATEBOARD ATTACHMENT

(76) Inventor: William Joseph Lumb, 8351 SE. Sunset St., Hobe Sound, FL (US) 33455

( * ) Notice: Subject to any disclaimer, the term of this patent is extended or adjusted under 35 U.S.C. 154(b) by 0 days.

(21) Appl. No.: 09/821,377

(22) Filed: Mar. 29, 2001

(65) Prior Publication Data

US 2002/0140195 A1 Oct. 3, 2002

(51) Int. Cl.[7] ..... B62M 1/00; A63C 17/26
(52) U.S. Cl. ..... 280/87.042
(58) Field of Search ..... 280/809, 811, 280/87.042, 611, 623, 816; 441/70, 74, 75

(56) References Cited

U.S. PATENT DOCUMENTS 4,159,121 A 6/1979 Spitzke
4,886,298 A * 12/1989 Shols ..... 280/842
5,484,312 A * 1/1996 Zepeda ..... 441/74
5,544,919 A * 8/1996 Tinkler ..... 280/809
5,641,172 A 6/1997 Hoffman et al.
5,997,018 A * 12/1999 Lee ..... 280/87.042
6,193,276 B1 * 2/2001 Sottile et al. ..... 280/816
6,199,881 B1 * 3/2001 Wood et al. ..... 280/87.042

* cited by examiner

*Primary Examiner*—Brian L. Johnson
*Assistant Examiner*—G B Klebe
(74) *Attorney, Agent, or Firm*—McHale & Slavin

(57) ABSTRACT

A skating device having clips that allows a rider to position the sole of a shoe beneath to the lip so as to secure a rider's shoe to the platform. The clip may be permanently or releasably secured and sized to fit conventional shoes. A professional version includes a specialty shoe that provides additional securement. Releasably secured clips may be concealed to allow the skateboard to be used in a conventional manner.

3 Claims, 2 Drawing Sheets

SKATEBOARD ATTACHMENT

FIELD OF THE INVENTION

This invention relates generally to skateboards and more particularly to a skateboard attachment for gripping shoes.

BACKGROUND INFORMATION

Skateboarding includes a colorful history dating back to the 1950's when the public began to equate skateboarding to the well established sport of surfing. Skateboarding was found as a substitute for surfing wherein an individual could improve balancing skills, a common element between the sports. Skateboarding was originally limited to streets and sidewalks and consisted of a board with clay wheels mounted to a bottom side. In the 1970's, urethane wheels were introduced leading to a significant improvement by providing a stronger wheel that could handle slalom and downhill skateboarding.

To accommodate the vast improvement in skateboards, skate parks were built moving the skateboarder from a horizontal plane to vertical. Trick or freestyle skateboarding developed including numerous aerial moves named after the inventor "ollies" where a rider taps on the tail of a board with one foot and sliding the other allows a rider to jump over immovable objects. Rollerblading has invaded most every skateboard park even though the sports are distinct. However, skateboarding remains safer than rollerblading and maintains a following who developed a "streetstyle" wherein technical tricks add to the enjoyment with or without the use of a skatepark.

The skateboard has evolved from a flat wood plank with clay wheels to polyurethane or wood platforms with frictionless bearings supporting polyurethane wheels.

U.S. Pat. No. 4,159,121 discloses a grip accessory for skateboards. This accessory consists of an elevated pedestal located along each end of a skateboard. The objective of the pedestal is to allow a rider to perform handstands as well as the shoes of a rider to fit under the pedestal. The pedestal is large and may act as an obstruction to the use of the board and safety of an individual. Placement of the foot beneath the pedestal inhibits quick release. Further, the size of the pedestals are so large that freestyle skateboarding is dictated by the pedestal configuration.

U.S. Pat. No. 5,641,172 discloses a skateboard having boots secured to the top portion of the skateboard platform. Although this attachment securely fastens a rider's feet to the platform, this attachment limits use of the board to skateboard parks where no foot push is required. The rigid attachment is also considered unacceptable should the rider fall.

Thus, what is lacking in the art is a means for securing shoes to a skateboard that does not inhibit normal use or add to the bulk of a board.

SUMMARY OF THE INVENTION

Disclosed is a skating device formed from a conventional skateboard oblong platform. The platform is supported by a pair of roller assemblies mounted proximate to a tail end section and a second pair of roller assemblies mounted proximate to a front end section of the platform. In a preferred embodiment, the skating device includes the use of a clip secured to the top surface of the platform along the tail section and the front section. The clips each include a lip or projection that allows a rider to position the sole of a shoe beneath the lip so as to secure the rider's shoe to the platform. The clip may be bolted, glued, or clamped allowing for the modification of existing skateboard to include use of the clip. Further, such installation methods can allow disassembly of the clips for use of the skateboard without the shoe locks if a single clip is desired or in need of replacement. Alternatively, the clips can be formed integral with the platform.

In an alternative embodiment, the clips can be raised for use and stored when not in use by lowering. In this embodiment, the clips can be lowered when not in use to a position flush with the upper surface of the platform. A rider can use the skateboard in its ordinary manner and then raise one or both of the clips to engage the soles of their shoes. The clips can further be removed without the need for tools.

In yet another embodiment, the clips can be formed to engage a speciality shoe wherein the clips operate in the same format as the previous embodiments, however, a modified shoe is adapted to provide superior attachment necessary for competitive freestyle boarding.

Thus, an objective of the invention is to disclose the use of hooks for securing the sole of a shoe, and thus the foot placed within the shoe, to the skateboard.

Still another objective of the invention is to disclose shoe attachments that are indiscrete and do not inhibit foot removal when necessary.

Another objective of the invention is to disclose the use of removable or retractable hooks that allow the use of a skateboard without surface protrusions.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION

Although the invention has been described in terms of specific embodiments, it will be readily apparent to those skilled in this art that various modifications, rearrangements and substitutions can be made without departing from the spirit of the invention. The scope of the invention is defined by the claims appended hereto.

Figure 1:
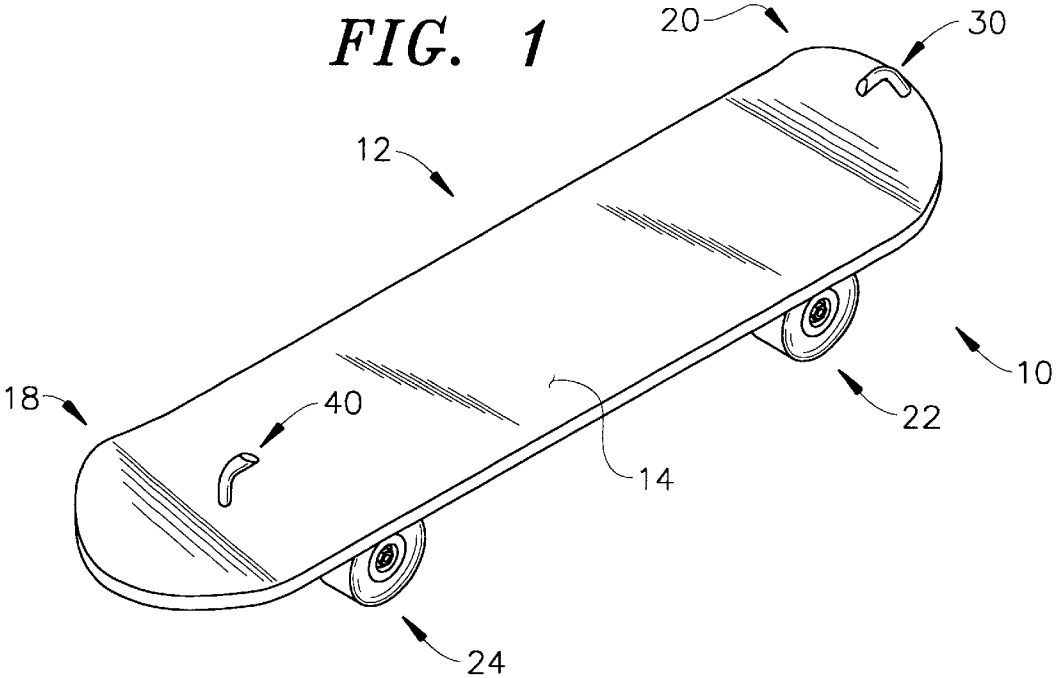
FIG. 1 is a perspective view of the instant invention having the clips extending over the surface of the board.
Figure 2:
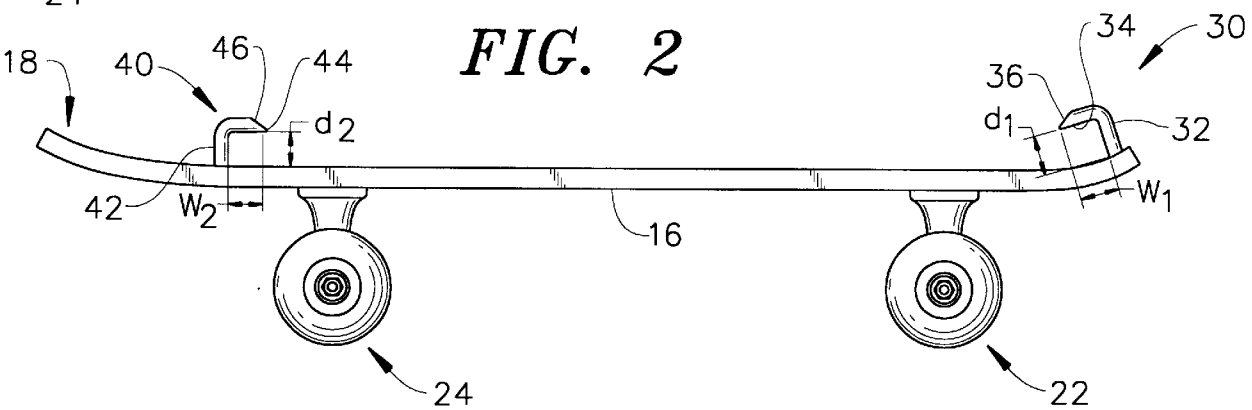
FIG. 2 is a side view of FIG. 1.

Now referring to FIGS. 1 and 2, set forth is a perspective view of a skateboard 10 comprising an oblong platform 12 having a top surface 14, a bottom surface 16, a front end section 18, and a tail end section 20. A first pair of roller assemblies 22 mounted to the bottom surface 16 and proximate to the tail end section 20 operates with a second pair of roller assemblies 24 which are also mounted to the bottom surface 16 and located proximate to the front end section 18. The use of a platform 12 and roller assemblies 22, 24 (wheels) are well known in the art and can be constructed of any number of materials including plastic or wood, or combination thereof.

A first clip 30 formed from a rigid material such as polyurethane, metal, or the like rigid material and can be permanently secured to the top surface 14 proximate to the tail end section 20. The first clip includes a vertical upright 32 sized to extend a distance dl above the lip of a shoe sole terminating with a horizontal extension 34 projecting toward the front end section 18 a width wl which permits extension over the edge or "lip" of a shoe sole. For instance, common deck shoes such as those manufactured under the name DOCKSIDERS have a sole with leather uppers sewn to the sole leaving an exposed lip approximately ⅛ inch thick by ¼ inch width. The distance dl of vertical upright 32 and width of horizontal extension wl is sized to accommodate the shoe sole arrangement. In addition, it is well known that shoe soles are flexible which is necessary to walk. This flexibility provides a relief should a rider fall as will be explained later in this specification. The clip 30 includes an upper angled surface 36 that allows for a comfortable placement between the shoe sole and the shoe upper. The clip 30 can be permanently secured to the platform 12 by a fastener such as a bolt, screw, glue or the like. Alternatively, a permanent attachment may consist of forming the clip as an integral process in the formation of the platform. The clip allows a rider to hook their shoe beneath the clip so as to temporarily secure their shoe, and thus their foot, to the platform. The clip 30 allows the rider to freestyle, such as jump, without holding on to the platform. Should the rider fall, the inherent flexibility of shoe sole will instantly allow release of the rider's foot.

A second clip 40 is also formed from a rigid material such as polyurethane, metal or the like rigid material and can be permanently secured to the top surface 14 proximate to the front end section 18. The second clip includes a vertical upright 42 sized to extend a distance d2 above the lip of a shoe sole terminating with a horizontal extension 44 projecting toward the rear end section 20 a width w2 which permits extension over the edge or "lip" of a shoe sole. The distance d2 of vertical upright 42 and width of horizontal extension w2 is sized to accommodate the shoe sole arrangement which may or may not be the same style shoe worn on the other foot of the rider. The clip 40 includes an upper angled surface 46 that allows for a comfortable placement between the shoe sole and the shoe upper. The clip 40 can be permanently secured to the platform 12 by a fastener such as a bolt, screw, glue or the like. Alternatively, a permanent attachment may consist of forming the clip as an integral process in the formation of the platform. As with the first clip 30 the second clip 40 allows a rider to hook their shoe beneath the clip so as to temporarily secure their shoe, and thus their foot, to the platform. The clip 40 also allows the rider to freestyle, such as jump, without holding on to the platform. Should the rider fall, the inherent flexibility of the shoe sole will instantly allow release of the rider's foot. The first and second clip are preferably located along a longitudinal axis which is defined as a center axis running along the middle of the platform.

Figure 3:
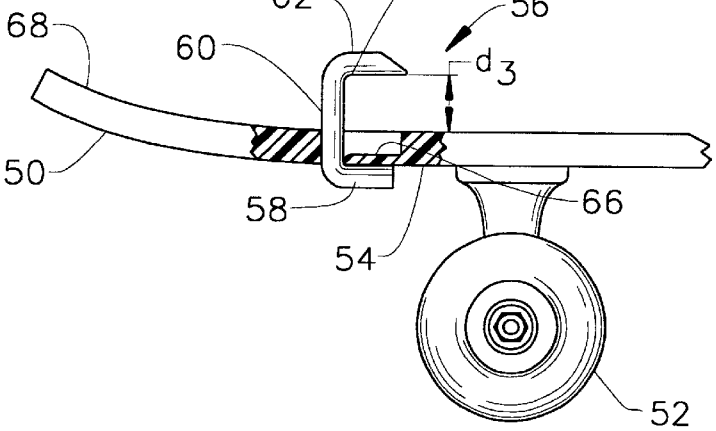
FIG. 3 is an enlarged side view of a clip in a raised position.

Now referring to FIG. 3, set forth is the partial view of a skateboard consisting of a platform 50 having wheels 52 located along bottom surface 54 of the platform. In this embodiment, clip 56 is depicted in a raised position having a bottom vertical extension 58, a vertical upright 60 and an upper horizontal extension 62. As with the previous embodiments, the vertical upright 60 provides a spacial distance d3 between the platform and the upper vertical extension 62. Similarly the upper vertical extension 62 projects over the platform a width w3 sufficient to engage a shoe sole.

Figure 4:
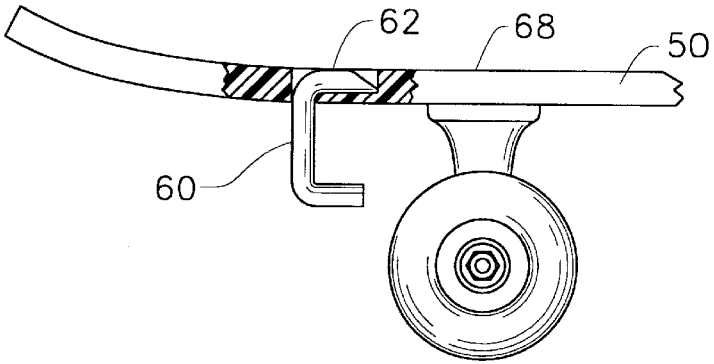
FIG. 4 is an enlarged side view of a clip in a stored position.

In operation a shoe fits beneath the upper horizontal extension 62 and against vertical upright 60 whereas in the previous embodiment the shoe of the rider is secured to the platform. As the individual pushes forward or upward the lower horizontal extension 58 is locked against the bottom surface 54 so as to prevent movement of the clip. When the clip is not in use, the upper horizontal extension is pushed into platform cavity 66 wherein it becomes flushed with the upper surface 68 of the platform and lower horizontal extension 58 is dislodged from the lower surface 54. As shown in FIG. 4 the clip is in a stored position wherein the upper portion of horizontal extension 62 is shown flush with the surface 68 of the platform 50 allowing an individual to stand directly over the clip 60 allowing use of the skateboard in its normal and everyday fashion.

Not shown are various alternative embodiments for hooking of the clip in a removable fashion, such as the use of a hinge so as the clip may be raised or lowered for use. In such an embodiment the clip would consist of an upright vertical section and a horizontal extension as shown in FIGS. 1–4 and when placed in a stored position the vertical extension is laid horizontal while the horizontal extension is placed into a vertical position wherein the clip is simply laid onto the platform with the upper portion extending through the platform for concealment.

Figure 5:
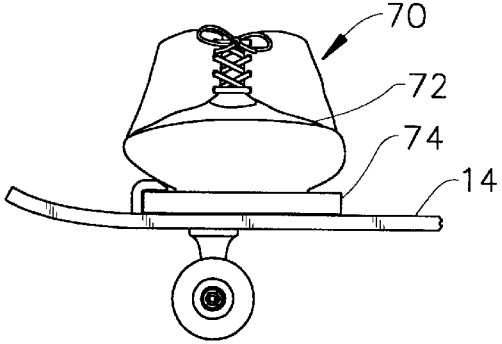
FIG. 5 is a partial side view illustrating the use of a conventional shoe engaging a clip.

Referring to FIG. 5, shown is a conventional shoe 70, such as the previously mentioned DOCKSIDERS, having an upper sole 72 and a lower sole 74. As noted, the lower sole 74 engages the clip 40 securing the shoes 72 to the platform surface 14. Pressure against the clip only serves to further secure the shoe in position with the chamfer following the contour of the upper sole.

Figure 6:
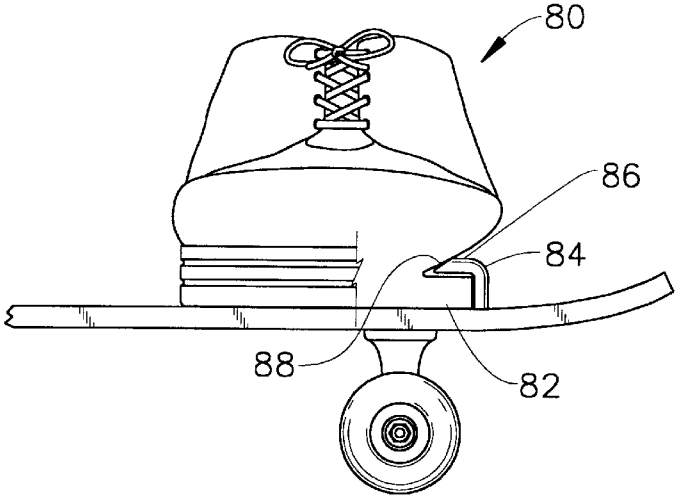
FIG. 6 is a partial side view of a clip illustrating a modified shoe engaging a clip.

FIG. 6 shows another embodiment wherein shoe 80 is modified having an extended sole 82 for use in engaging a modified clip 84. In this embodiment the modified clip 84 has an upper extension 86 which is enlarged so as to engage the shoe 80 for use in professional freestyling. As with the previous embodiments a chamfered section 88 allows for a comfortable fit to the upper sole of the rider. Although this embodiment is depicted as a professional version, the clip variation serves to demonstrate that the clip can be made of any size and shape to accommodate a particular shoe sole's width and height. Further, the platform can be made of any shape or material including raised end sections designed for trick boarding.

It is to be understood that while we have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What is claimed is:

1. A skating device for use with a shoe having an upper sole and a lower sole extending outwardly from said upper sole forming a lip, said skating device engaging the lower sole of said shoe relative to a skateboard, said device comprising:

an oblong platform having a top surface, a bottom surface, a front end section, a tail end section, and a longitudinal axis;

a first pair of roller assemblies mounted to said bottom surface proximate to said tail end section;

a second pair of roller assemblies mounted to said bottom surface proximate to said front end section;

a first clip secured to said top surface proximate to said tail end section having a vertical upright sized to extend above the lip of a first lower shoe sole with a horizontal extension projecting toward said front end section a distance sized to extend over said lip of said lower shoe sole, said horizontal extension positionable between said upper and lower shoe soles, said first clip may be locked in a raised position and positioned flush with said platform while in a stored position; and a second clip secured to said top surface proximate to said front end section having a vertical upright sized to extend above the lip of a second lower shoe sole with a horizontal extension projecting toward said tail end section a distance sized to extend over said lip of said lower shoe sole, said horizontal extension positionable between said upper and lower shoe soles, said second clip may be locked in a raised position during use and positioned flush with said platform while in a stored position; wherein said horizontal extension of said clips are positioned between said lower sole and said upper sole of said shoes.

2. The skating device according to claim 1 wherein each said clip includes a chamfered lip for positioning between said lower sole and upper sole of a shoe.

3. A skating device for use in combination with shoes having at least one side wall having a lower sole separated from an upper sole, said device comprising:

an oblong platform having a top surface, a bottom surface, a front end section, a tail end section, and a longitudinal axis;

a first pair of roller assemblies mounted to said bottom surface proximate to said tail end section;

a second pair of roller assemblies mounted to said bottom surface proximate to said front end section;

a first clip secured to said top surface proximate to said tail end section having a vertical upright sized to extend above the lower shoe sole of a first shoe with a horizontal extension projecting toward said front end section a distance sized to extend over a portion of said lower shoe sole, said horizontal extension positionable between said upper and lower shoe soles, said first clip may be locked in a raised position and positioned flush with said platform while in a stored position; and a second clip secured to said top surface proximate to said front end section having a vertical upright sized to extend above the lower shoe sole of a second shoe with a horizontal extension projecting toward said tail end section a distance sized to extend over a portion of said lower shoe sole, said horizontal extension positionable between said upper and lower shoe soles, said second clip may be locked in a raised position during use and positioned flush with said platform while in a stored position;

wherein said horizontal extension of said clips are positioned between said lower sole and said upper sole of said shoe.

* * * * *